US012680207B2

(12) United States Patent
Iimura et al.

(10) Patent No.: US 12,680,207 B2
(45) Date of Patent: Jul. 14, 2026

(54) SEWING MACHINE PRESSER FOOT

(71) Applicant: JUKI CORPORATION, Tama (JP)

(72) Inventors: Honoka Iimura, Tokyo (JP); Norio Yanagisawa, Tokyo (JP); Eiji Fukumori, Tokyo (JP); Tsuyoshi Hanada, Tokyo (JP)

(73) Assignee: JUKI CORPORATION, Tama (JP)

( * ) Notice: Subject to any disclaimer, the term of this patent is extended or adjusted under 35 U.S.C. 154(b) by 0 days.

(21) Appl. No.: 19/171,793

(22) Filed: Apr. 7, 2025

(65) Prior Publication Data

US 2025/0314001 A1 Oct. 9, 2025

(30) Foreign Application Priority Data

Apr. 8, 2024 (JP) ..... 2024-062314

(51) Int. Cl.
*D05B 29/08* (2006.01)

(52) U.S. Cl.
CPC ..... *D05B 29/08* (2013.01)

(58) Field of Classification Search
CPC ..... D05B 29/02; D05B 27/06; D05B 29/06; D05B 29/08; D05B 29/00; D05B 29/12; D05B 3/02
See application file for complete search history.

(56) References Cited

U.S. PATENT DOCUMENTS 5,540,163 A * 7/1996 Reinhart ..... D05B 29/08 112/235

FOREIGN PATENT DOCUMENTS

| | | | | |
|---|---|---|---|---|
| CN | 209602757 U | | 11/2019 | |
| CN | 219951385 U | * | 11/2023 | |
| EP | 2770099 A1 | | 8/2014 | |
| JP | 2014-161431 A | | 9/2014 | |
| WO | WO-2010113314 A1 | * | 10/2010 | ..... D05B 29/08 |

OTHER PUBLICATIONS

Extended European Search Report issued Jun. 23, 2025 in Application No. 25169058.2.

* cited by examiner

*Primary Examiner* — Khoa D Huynh
*Assistant Examiner* — Erick I Lopez
(74) *Attorney, Agent, or Firm* — Faegre Drinker Biddle & Reath LLP

(57) ABSTRACT

A sewing machine presser foot being attached to a presser foot bar provided near a needle bar via a presser foot support member in a sewing machine, the sewing machine including a throat plate and a needle bar up-down movement mechanism configured to cause an up-down movement of the needle bar holding a sewing needle. The sewing machine presser foot includes: a first presser foot and a second presser foot supported by the presser foot support member; a first presser foot portion supported to be movable up and down in conjunction with the up-down movement of the needle bar; a second presser foot portion supported to be movable up and down; and an adjustment portion configured to adjust a height position of the second presser foot portion with respect to the throat plate.

6 Claims, 6 Drawing Sheets

SEWING MACHINE PRESSER FOOT

CROSS-REFERENCE TO RELATED APPLICATIONS

The present application claims the benefit of priority of Japanese Patent Application No. 2024-062314, filed on Apr. 8, 2024, the content of which is incorporated herein by reference.

TECHNICAL FIELD

The present invention relates to a sewing machine presser foot.

BACKGROUND ART

Conventionally, for example, in a sewing machine that performs embroidery sewing or free-motion sewing, there has been known a sewing machine presser foot in which a presser foot portion moves up and down in accordance with the up-down movement of a needle bar of the sewing machine (for example, refer to JP2014-161431A).

The sewing machine presser foot is equipped with an operating arm, a needle clamp part of the needle bar comes into contact with the operating arm from below to push up the operating arm, and thus the presser foot moves up and down in conjunction with the up-down movement of the needle bar.

However, in the case of a presser foot that moves up and down in accordance with the up-down movement of the needle bar, as in JP2014-161431A, the presser foot portion does not hold down the fabric from the time the needle clamp part of the needle bar pushes up the presser foot until the thread take-up lever finishes pulling up the upper thread, and thus there is a problem in that the fabric could be lifted and flutter due to the upper thread being pulled up by the sewing needle or the thread take-up lever, causing the thread tensioner to become unstable.

SUMMARY

An object of the present invention is to provide a sewing machine presser foot that enables sewing with stable thread tensioner.

In order to solve the above problems, according to the invention described in claim 1, there is provided a sewing machine presser foot, which is attached to a presser foot bar provided near a needle bar via a presser foot support member, in a sewing machine including a throat plate and a needle bar up-down movement mechanism that causes an up-down movement of the needle bar holding a sewing needle, in which a first presser foot and a second presser foot supported by the presser foot support member are provided, the first presser foot includes a first presser foot portion supported to be movable up and down in conjunction with the up-down movement of the needle bar, and the second presser foot includes a second presser foot portion supported to be movable up and down, and an adjustment portion for adjusting a height position of the second presser foot portion with respect to the throat plate.

According to the invention described in claim 2, in the sewing machine presser foot described in claim 1, the position of the second presser foot portion of the second presser foot is adjusted by the adjustment portion to a height at which the second presser foot portion does not come into contact with a fabric placed on the throat plate.

According to the invention described in claim 3, in the sewing machine presser foot described in claim 2, the first presser foot portion moves up and down to a height at which the first presser foot portion is positioned below the second presser foot portion and abuts against the throat plate, and a height at which the first presser foot portion is positioned above the second presser foot portion.

According to the invention described in claim 4, in the sewing machine presser foot described in any one of claims 1 to 3, the first presser foot includes a spring member that biases the first presser foot portion toward the throat plate, and a contact arm portion that comes into contact with the needle bar when the needle bar rises and transmits an upward movement of the needle bar to the first presser foot portion, and the second presser foot includes a spring member that biases the second presser foot portion toward the throat plate.

According to the invention described in claim 5, in the sewing machine presser foot described in claim 4, a first through-hole and a second through-hole that penetrate in an up-down direction are formed in the presser foot support member, the first presser foot includes a first shaft portion that is inserted into the first through-hole, in the first shaft portion, the contact arm portion is provided on an upper end side, and the first presser foot portion is provided on a lower end side, the second presser foot includes a second shaft portion inserted into the second through-hole, and in the second shaft portion, the adjustment portion is provided on an upper end side, and the second presser foot portion is provided on a lower end side.

According to the invention described in claim 6, in the sewing machine presser foot described in claim 5, in the first presser foot portion, a first guide shaft parallel to the first shaft portion is erected, in the second presser foot portion, a second guide shaft parallel to the second shaft portion is erected, in the presser foot support member, a first guide hole and a second guide hole that penetrate in the up-down direction are formed, and the first guide shaft is inserted into the first guide hole, and the second guide shaft is inserted into the second guide hole.

According to the present invention, a sewing machine presser foot that enables sewing with stable thread tensioner is obtained.

DESCRIPTION OF EMBODIMENTS

Embodiments of the present invention will be described in detail below.

A sewing machine presser foot is used by being attached to a sewing machine, and has the function of pressing down the workpiece during sewing.

Figure 1:
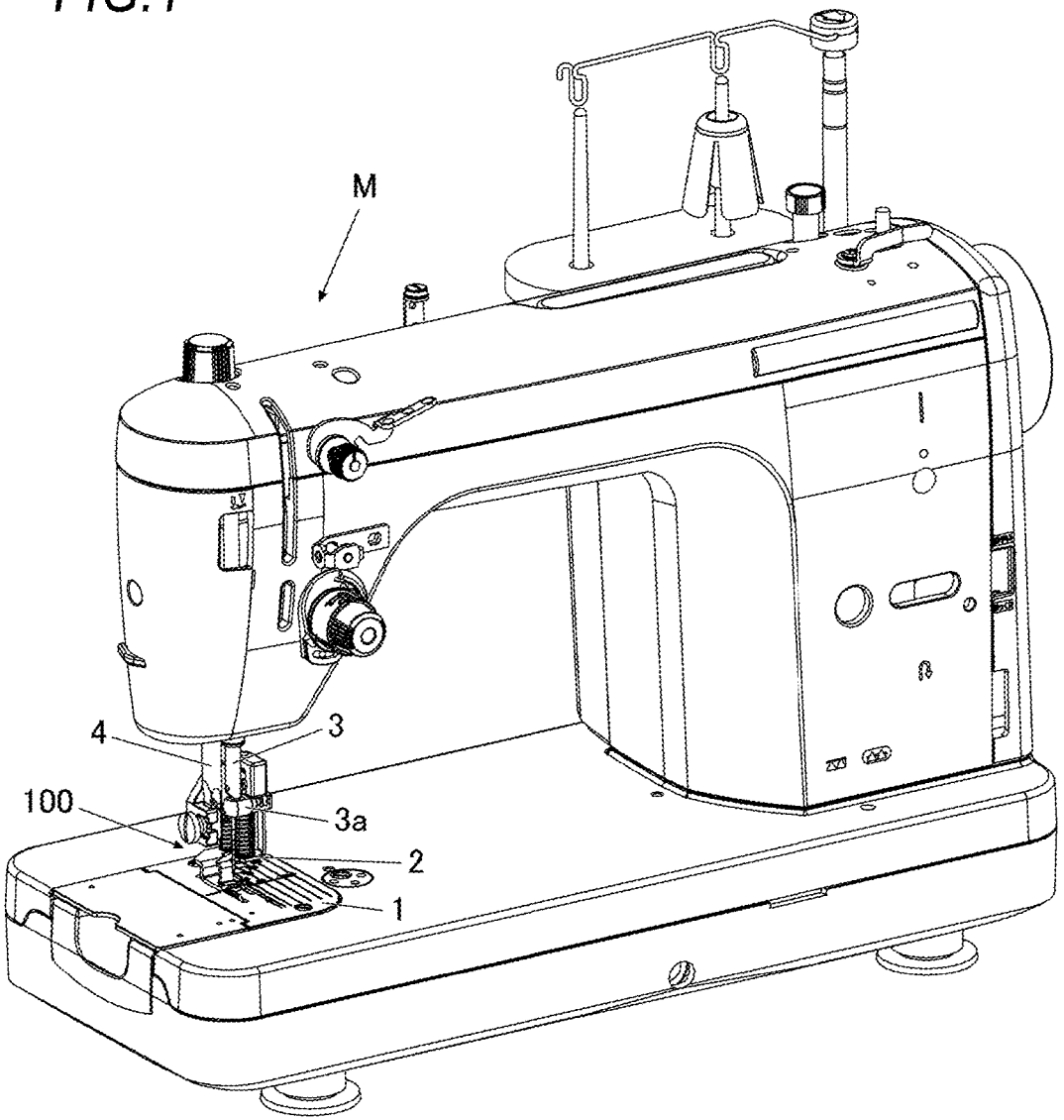
FIG. 1 is a perspective view of a sewing machine to which a sewing machine presser foot according to the present embodiment is attached.
Figure 2:
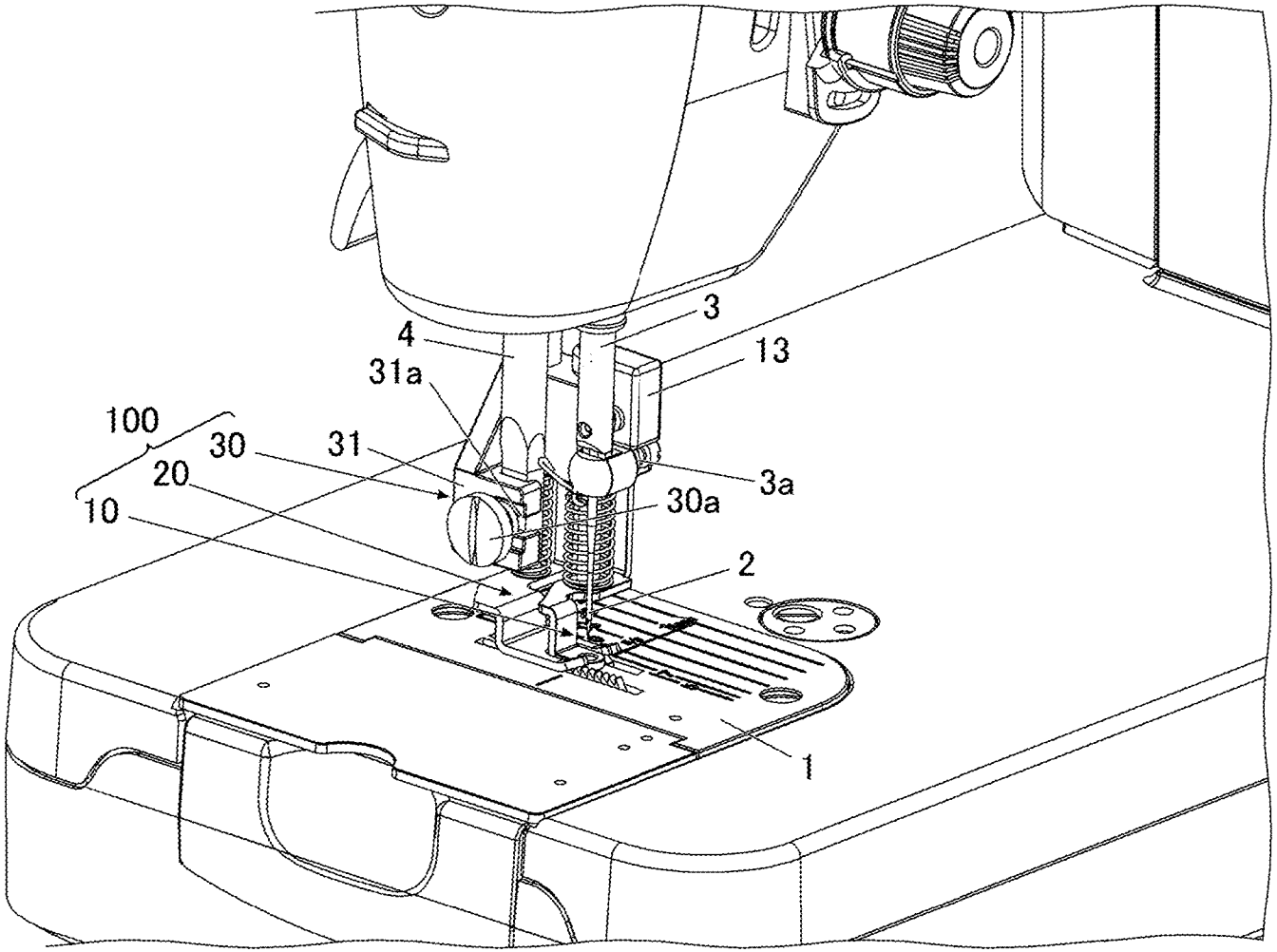
FIG. 2 is a perspective view showing the sewing machine presser foot attached to the sewing machine.
Figure 3:
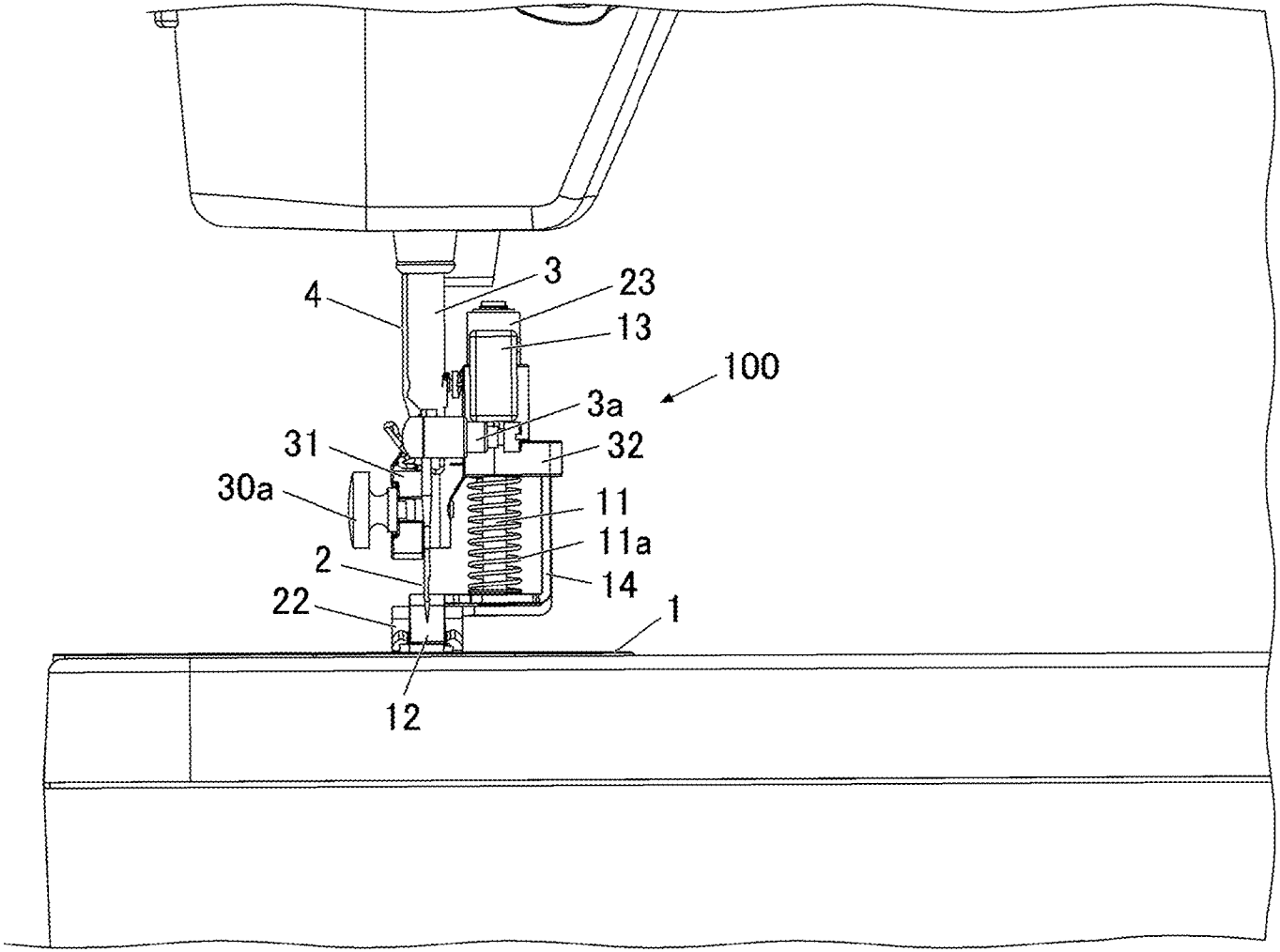
FIG. 3 is a front view showing the sewing machine presser foot attached to the sewing machine.
Figure 4A:
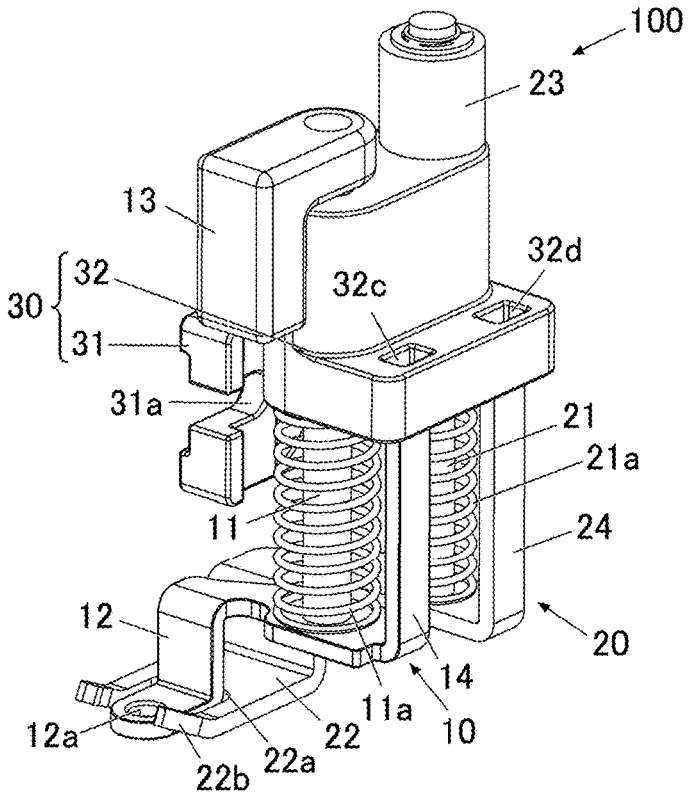
FIG. 4A is a perspective view showing the sewing machine presser foot according to the present embodiment.
Figure 4B:
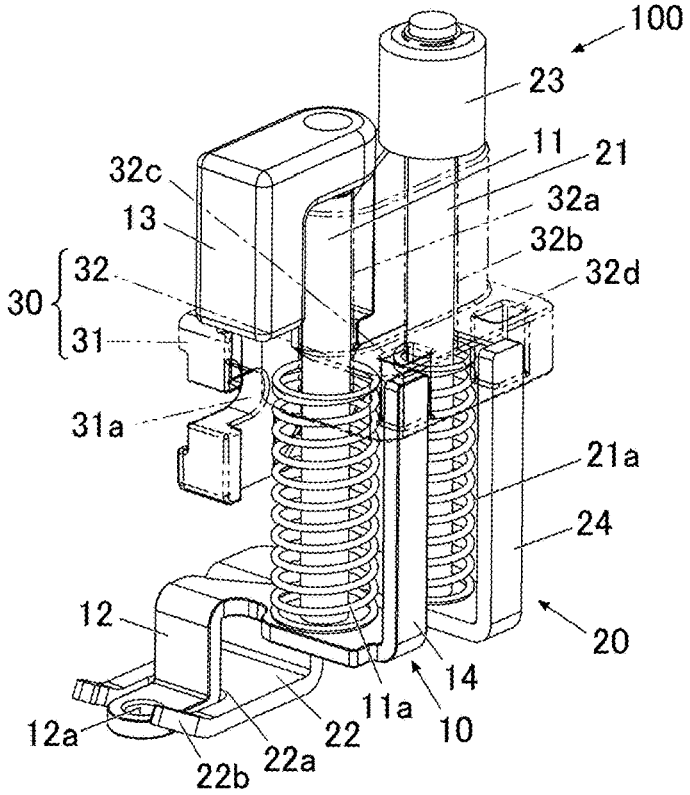
FIG. 4B is a perspective view showing a partially transparent view of the sewing machine presser foot.

A sewing machine presser foot 100 of the present embodiment is used by being attached to a presser foot bar 4 of a sewing machine M, for example, as shown in FIGS. 1 to 3.

This sewing machine M includes a throat plate 1, a needle bar 3 that has a needle clamp portion 3*a* for holding a sewing needle 2 and moves up and down, the presser foot bar 4 provided near the needle bar 3, and the like.

The needle clamp portion 3*a* of the needle bar 3 has a screw-type knob for loosening or tightening when attaching the sewing needle 2 to the lower end portion of the needle bar 3, and protrudes substantially perpendicularly to the needle bar 3.

In addition, when a predetermined presser foot is arranged in advance on the presser foot bar 4 of the sewing machine M, instead of that presser foot, the sewing machine presser foot 100 of the present embodiment is used by being attached to the presser foot bar 4.

In addition, the sewing machine M also includes a needle bar up-down movement mechanism that causes the up-down movement of the needle bar 3 holding the sewing needle 2, a shuttle mechanism that catches the upper thread passed through the sewing needle 2 and intertwines the upper thread with the lower thread, a thread take-up lever mechanism that pulls up the upper thread to form a knot, and the like, which are housed in a sewing machine frame.

The sewing machine frame includes a bed portion positioned at the lower portion of a sewing machine main body, a vertical body portion erected from one end portion of the bed portion, and an arm portion extending from the vertical body portion in the same direction as the bed portion.

The throat plate 1 is provided on the bed portion, and the needle bar 3 and the presser foot bar 4 are provided on the arm portion.

The configuration and operation of each mechanism of this sewing machine M are similar to those conventionally known, and therefore will not be described in detail here.

The sewing machine M is a sewing machine capable of performing so-called free-motion sewing, in which an operator freely moves the fabric as a workpiece by hand and performs sewing while positioning the fabric relative to the needle drop position.

The sewing machine presser foot 100 of the present embodiment includes a first presser foot 10, a second presser foot 20, and a presser foot support member 30 that supports the first presser foot 10 and the second presser foot 20, as shown in, for example, FIG. 2, FIG. 4A, FIG. 4B, FIG. 5A and FIG. 5B.

The presser foot support member 30 includes an attachment portion 31 for attaching the sewing machine presser foot 100 to the presser foot bar 4, and a support portion main body 32 for supporting the first presser foot 10 and the second presser foot 20.

The attachment portion 31 is provided with a notched groove portion 31*a*.

In a state where the presser foot bar 4 is added in the attachment portion 31, a fixing screw 30*a* is screwed into a fixing hole (not shown) of the presser foot bar 4 through the groove portion 31*a*, the attachment portion 31 is clamped between the fixing screw 30*a* and the presser foot bar 4, the presser foot support member 30 is fixed to the presser foot bar 4, and accordingly, the sewing machine presser foot 100 can be attached to the presser foot bar 4.

Furthermore, the configuration and attachment method of this attachment portion 31 are similar to those conventionally known, and the sewing machine presser foot 100 of the present embodiment ensures compatibility with conventional presser foot.

A first through-hole 32*a* and a second through-hole 32*b*, which are a pair of through-holes penetrating in the up-down direction, are formed in the support portion main body 32. A shaft portion of a presser foot, which will be described later, is inserted into this through-hole.

Further, the support portion main body 32 is formed with a pair of guide holes, a first guide hole 32*c* and a second guide hole 32*d*, which penetrate in the up-down direction. A guide shaft of a presser foot, which will be described later, is inserted into this guide hole.

These four holes (first through-hole 32*a*, second through-hole 32*b*, first guide hole 32*c*, and second guide hole 32*d*) are formed parallel to each other.

The first presser foot 10 includes a first shaft portion 11 that is inserted into the first through-hole 32*a* of the presser foot support member 30, a first presser foot portion 12 that is provided on the lower end side of the first shaft portion 11 and arranged above the throat plate 1, and a contact arm portion 13 that is provided on the upper end side of the first shaft portion 11 and is lifted by coming into contact with the needle clamp portion 3*a* when the lowered needle bar 3 rises.

Further, in the first presser foot portion 12, a first guide shaft 14 parallel to the first shaft portion 11 is erected, and the first guide shaft 14 is inserted into the first guide hole 32*c* 20 of the presser foot support member 30.

The first presser foot portion 12 has a bent shape such that the tip end part is disposed substantially parallel to the throat plate 1, and an eye 12*a* into which the sewing needle 2 is loosely inserted is provided at the tip end part.

The tip end part of the first presser foot portion 12 is a presser foot part that presses 25 the fabric placed on the throat plate 1.

In addition, the first presser foot 10 also includes a coil spring 11*a*, which is a spring member that biases the first presser foot portion 12 toward the throat plate 1, and the first presser foot portion 12 is elastically supported to be movable up and down.

The coil spring 11*a* is fitted into the first shaft portion 11 and arranged between the 30 first presser foot portion 12 and the support portion main body 32, the lower end portion of the coil spring 11*a* abuts against the first presser foot portion 12, and the upper end portion abuts against the support portion main body 32.

The contact arm portion 13 is fixed to the upper end portion of the first shaft portion 11 such that a part of the contact arm portion 13 protrudes toward the side surface of the support portion main body 32.

The needle clamp portion 3*a* that rises integrally with the needle bar 3 comes into contact with this contact arm portion 13, and the contact arm portion 13 is pushed up together with the needle clamp portion 3*a*. In other words, when the needle bar 3 rises, the needle clamp portion 3*a* comes into contact with the contact arm portion 13 and transmits the upward movement of the needle bar 3 to the first presser foot portion 12.

Then, as the contact arm portion 13 is pushed up by the needle clamp portion 3*a*, the first presser foot portion 12 rises together with the first shaft portion 11. At this time, the coil spring 11*a* contracts between the first presser foot portion 12 and the support portion main body 32.

Further, when the needle bar 3 (needle clamp portion 3*a*) is lowered, the first shaft portion 11 and the first presser foot portion 12 are also lowered integrally with the contact arm portion 13 due to the biasing force caused by the extension of the coil spring 11*a*.

In this manner, by moving the first presser foot 10 up and down in conjunction with the up-down movement of the needle bar 3, the height of the first presser foot portion 12 is moved up and down.

In particular, since the first shaft portion 11 and the first guide shaft 14 of the first presser foot 10 are inserted into the first through-hole 32*a* and the first guide hole 32*c* of the support portion main body 32, respectively, the posture of the first presser foot portion 12 is hardly disturbed, and the up-down movement of the first presser foot portion 12 is stabilized.

The second presser foot 20 includes a second shaft portion 21 that is inserted into the second through-hole 32*b* of the presser foot support member 30, a second presser foot portion 22 that is provided on the lower end side of the second shaft portion 21 and arranged above the throat plate 1, and an adjustment portion 23 that is provided on the upper end side of the second shaft portion 21 for adjusting the position of the second shaft portion 21 in the up-down direction.

Further, in the second presser foot portion 22, a second guide shaft 24 parallel to the second shaft portion 21 is erected, and the second guide shaft 24 is inserted into the second guide hole 32*d* of the presser foot support member 30.

The second presser foot portion 22 has a bent shape such that the tip end part thereof is arranged substantially parallel to the throat plate 1.

A notch portion 22*a* is provided at the tip end part of the second presser foot portion 22 for causing the tip end part of the first presser foot portion 12 to pass therethrough up and down.

Furthermore, on both sides of the notch portion 22*a* at the tip end part of the second presser foot portion 22, there are curved portions 22*b* in which the edges of the tip end part are bent upward.

In addition, the second presser foot 20 also includes a coil spring 21*a*, which is a spring member that biases the second presser foot portion 22 toward the throat plate 1, and the second presser foot portion 22 is elastically supported to be movable up and down.

The coil spring 21*a* is fitted into the second shaft portion 21 and arranged between the second presser foot portion 22 and the support portion main body 32, the lower end portion of the coil spring 21*a* abuts against the second presser foot portion 22, and the upper end portion abuts against the support portion main body 32.

Figure 6:
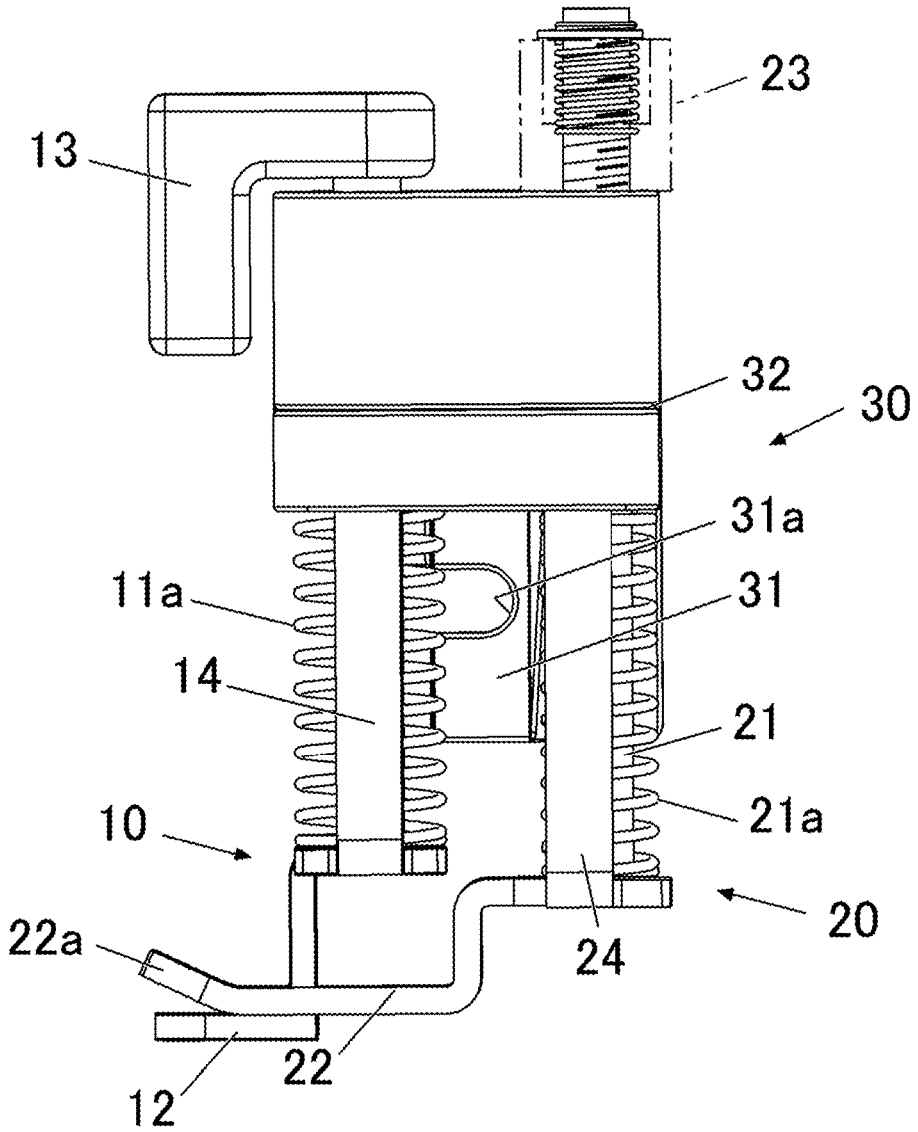
FIG. 6 is a partially transparent side view of the sewing machine presser foot according to the present embodiment.

The adjustment portion 23 is, for example, a female screw-shaped member screwed onto a male screw part formed on the upper end side of the second shaft portion 21, as shown in FIG. 6.

When the adjustment portion 23 is turned clockwise toward the support portion main body 32 to be tightened, the second shaft portion 21 relatively spirals upward, and the second presser foot portion 22 rises away from the throat plate 1. Furthermore, when the adjustment portion 23 is turned counterclockwise, the second shaft portion 21 is screwed relatively downward, and the second presser foot portion 22 is lowered to approach the throat plate 1.

It is possible to install the second presser foot portion 22 at a height corresponding to the position of the second shaft portion 21 adjusted by the adjustment portion 23.

In particular, since the second shaft portion 21 and the second guide shaft 24 of the second presser foot 20 are inserted into the second through-hole 32*b* and the second guide hole 32*d* of the support portion main body 32, respectively, the posture of the second presser foot portion 22 is hardly disturbed, and the up-down movement of the second presser foot portion 22 is stabilized.

Next, the function of the sewing machine presser foot 100 of the present embodiment will be described.

In a state where the sewing machine presser foot 100 is attached to the presser foot bar 4 of the sewing machine M, and the needle clamp portion 3*a* of the needle bar 3 is not in contact with the contact arm portion 13 of the first presser foot 10, the tip end part of the first presser foot portion 12 of the first presser foot 10 abuts against the throat plate 1 at a position lower than the tip end part of the second presser foot portion 22 of the second presser foot 20.

The first presser foot 10 includes the coil spring 11*a* that biases the first presser foot portion 12 toward the throat plate 1, and the first presser foot portion 12 is elastically supported to be movable up and down. Accordingly, the tip end part of the first presser foot portion 12 abuts in a manner of abutting the throat plate 1.

The tip end part of the first presser foot portion 12 that abuts against the throat plate 1 presses the fabric placed on the throat plate 1.

On the other hand, the height of the second presser foot portion 22 of the second presser foot 20 is adjusted by the adjustment portion 23, and the tip end part of the second presser foot portion 22 is positioned away from the throat plate 1.

The position of the tip end part of the second presser foot portion 22 positioned away from the throat plate 1 is adjusted to a height at which the tip end part does not come into contact with the fabric placed on the throat plate 1.

In this manner, the needle clamp portion 3*a* of the needle bar 3 is not in contact with the contact arm portion 13 of the first presser foot 10, and at the timing when the needle bar 3 is lowered and the sewing needle 2 pierces the fabric, the fabric placed on the throat plate 1 is pressed by the tip end part of the first presser foot portion 12.

Figure 5A:
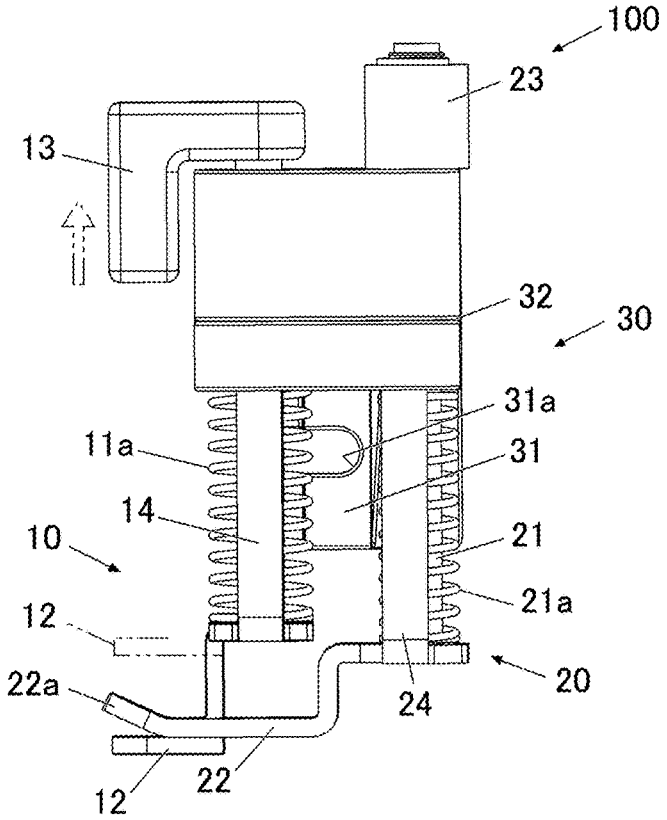
FIG. 5A is a side view showing the sewing machine presser foot according to the present embodiment.
Figure 5B:
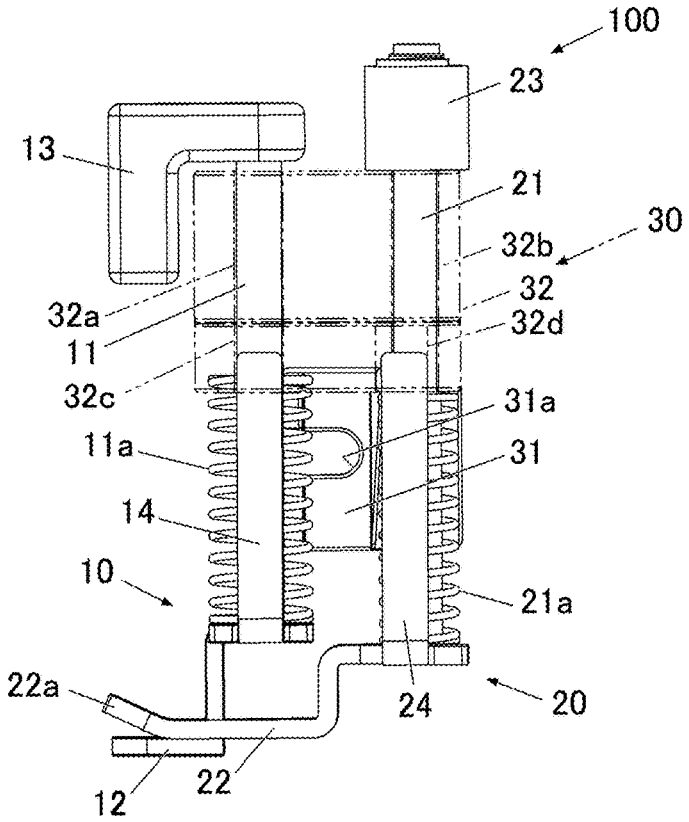
FIG. 5B is a side view showing a partially transparent view of the sewing machine presser foot.

Further, in a state where the needle bar 3 is raised and the needle clamp portion 3*a* of the needle bar 3 pushes up the contact arm portion 13 of the first presser foot 10, the first presser foot portion 12 of the first presser foot 10 is raised, and the tip end part of the first presser foot portion 12 is positioned above the tip end part of the second presser foot portion 22 (refer to FIG. 5A; the first presser foot portion 12 indicated by a chain line).

While the needle clamp portion 3*a* of the needle bar 3 is pushing up the contact arm portion 13 of the first presser foot 10 in this manner, the tip end part of the first presser foot portion 12 is not pressing the fabric placed on the throat plate 1.

On the other hand, the tip end part of the second presser foot portion 22 of the second presser foot 20 is arranged slightly away from the throat plate 1 but relatively close to the fabric on the throat plate 1, and thus while the tip end part of the first presser foot portion 12 is positioned above the tip end part of the second presser foot portion 22, the tip end part of the second presser foot portion 22 can restrict the fabric from being lifted upward due to the friction of the upper thread pulled up by the thread take-up lever.

That is, when sewing is performed on the sewing machine M to which the sewing machine presser foot 100 of the present embodiment is attached, at the timing when the needle bar 3 is lowered and the sewing needle 2 pierces the fabric, the fabric placed on the throat plate 1 can be pressed at the tip end part of the first presser foot portion 12, and while the needle bar 3 is raised and the needle clamp portion 3*a* of the needle bar 3 is pushing up the first presser foot 10, lifting of the fabric by the upper thread can be restricted by the tip end part of the second presser foot portion 22.

In a state where the needle bar 3 is raised and the sewing needle 2 is removed from the fabric, the fabric placed on the throat plate 1 is not pressed by the first presser foot portion 12 or the second presser foot portion 22, and thus the fabric on the throat plate 1 can be smoothly moved and free-motion sewing can be performed suitably.

Note that the tip end part of the second presser foot portion 22 positioned away from the throat plate 1 is at a constant height above the throat plate 1, and thus, when there is a partially thick step portion in the fabric, the tip end part of the second presser foot portion 22 may come into contact with the step portion. However, the second presser foot 20 has the coil spring 21*a* that biases the second presser foot portion 22 toward the throat plate 1, the second presser foot portion 22 is elastically supported to be movable up and down, and thus, when the tip end part of the second presser foot portion 22 comes into contact with a step portion of the fabric, the second presser foot portion 22 can move upward to retreat.

Further, the tip end part of the second presser foot portion 22 is provided with a curved portion 22*b* in which the edge of the tip end part is bent upward, and thus, when the tip end part of the second presser foot portion 22 comes into contact with a step portion of the fabric, the second presser foot portion 22 can suitably retreat to climb over the step portion.

As described above, the sewing machine presser foot 100 of the present embodiment has two types of presser foot portions: the first presser foot portion 12 that moves up and down in conjunction with the up-down movement of the needle bar 3, and the second presser foot portion 22 that is installed at a constant height above the throat plate 1. As a result, since the thread tensioner is not disturbed from the time when the sewing needle 2 comes out of the fabric until the thread take-up lever has finished pulling up the upper thread, free-motion sewing can be performed suitably.

Further, the shape of the attachment portion 31 of the sewing machine presser foot 100 of the present embodiment is the same as that of the attachment portion of a conventional presser foot. Further, since the presser foot 100 includes the first presser foot 10 and the second presser foot 20 integrated through the support portion main body 32, the two types of presser foot portions can be easily attached to the conventional sewing machine while maintaining compatibility with the conventional sewing machine presser foot.

In the above embodiment, the needle clamp portion 3*a* for holding the sewing needle 2 comes into contact with and pushes up the contact arm portion 13 of the first presser foot 10, thereby raising the first presser foot portion 12. However, a member that comes into contact with the contact arm portion 13 may be separately provided on the needle bar 3 to raise the first presser foot portion 12.

In the above embodiment, a case has been exemplified in which the sewing machine presser foot 100 is attached to the sewing machine M that performs free-motion sewing in which sewing is performed while positioning the fabric relative to the needle drop position, but the present invention is also applicable to a free-motion sewing machine in which the sewing machine side is moved relative to the fabric held on a predetermined placement surface.

Further, in the above embodiment, a case has been described in which the sewing machine presser foot 100 is attached to the sewing machine M capable of performing free-motion sewing, but the present invention is not limited to this, and the sewing machine presser foot 100 may be used by being attached to a sewing machine that performs embroidery sewing.

In addition, it goes without saying that the specific detailed structure and the like can also be changed as appropriate.

The invention claimed is:

1. A sewing machine presser foot being attached to a presser foot bar provided near a needle bar via a presser foot support member in a sewing machine, the sewing machine including a throat plate and a needle bar up-down movement mechanism configured to cause an up-down movement of the needle bar holding a sewing needle, the sewing machine presser foot comprising:

a first presser foot and a second presser foot supported by the presser foot support member;

a first presser foot portion supported to be movable up and down in conjunction with the up-down movement of the needle bar, the first presser foot portion being provided in the first presser foot;

a second presser foot portion supported to be movable up and down, the second presser foot portion being provided in the second presser foot; and an adjustment portion configured to adjust a height position of the second presser foot portion with respect to the throat plate, the adjustment portion being provided in the second presser foot, wherein the first presser foot includes a contact arm portion that comes into contact with the needle bar when the needle bar rises and transmits an upward movement of the needle bar to the first presser foot portion.

2. The sewing machine presser foot according to claim 1, wherein a position of the second presser foot portion of the second presser foot is configured to be adjusted by the adjustment portion to a height at which the second presser foot portion does not come into contact with a fabric placed on the throat plate.

3. The sewing machine presser foot according to claim 2, wherein the first presser foot portion is configured to move up and down to: a height at which the first presser foot portion is positioned below the second presser foot portion and abuts against the throat plate; and a height at which the first presser foot portion is positioned above the second presser foot portion.

4. The sewing machine presser foot according to claim 1, wherein the first presser foot further includes a spring member that biases the first presser foot portion toward the throat plate, and the second presser foot includes a spring member that biases the second presser foot portion toward the throat plate.

5. The sewing machine presser foot according to claim 4, wherein a first through-hole and a second through-hole that penetrate in an up-down direction are formed in the presser foot support member, the first presser foot includes a first shaft portion that is inserted into the first through-hole, in the first shaft portion, the contact arm portion is provided on an upper end side, and the first presser foot portion is provided on a lower end side, the second presser foot includes a second shaft portion inserted into the second through-hole, and in the second shaft portion, the adjustment portion is provided on an upper end side, and the second presser foot portion is provided on a lower end side.

6. The sewing machine presser foot according to claim 5, wherein in the first presser foot portion, a first guide shaft parallel to the first shaft portion is erected, in the second presser foot portion, a second guide shaft parallel to the second shaft portion is erected, in the presser foot support member, a first guide hole and a second guide hole that penetrate in the up-down direction are formed, and the first guide shaft is inserted into the first guide hole, and the second guide shaft is inserted into the second guide hole.

* * * * *